US009304455B2

(12) United States Patent
Arima

(10) Patent No.: US 9,304,455 B2
(45) Date of Patent: Apr. 5, 2016

(54) IMAGE FORMING APPARATUS AND DECOLORING APPARATUS

(71) Applicants: KABUSHIKI KAISHA TOSHIBA, Tokyo (JP); TOSHIBA TEC KABUSHIKI KAISHA, Tokyo (JP)

(72) Inventor: Yasuharu Arima, Mishima Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/482,554

(22) Filed: Sep. 10, 2014

(65) Prior Publication Data

US 2016/0070213 A1 Mar. 10, 2016

(51) Int. Cl.

| | |
|---|---|
| ***G03G 15/20*** | (2006.01) |
| ***G03G 15/00*** | (2006.01) |
| ***G03G 15/01*** | (2006.01) |

(52) U.S. Cl.

CPC ..... *G03G 15/2039* (2013.01); *G03G 15/01* (2013.01); *G03G 15/5062* (2013.01)

(58) Field of Classification Search

CPC .. G03G 15/2039; G03G 15/5062; B41J 29/36
USPC ..... 399/69, 1, 341, 15; 347/179
See application file for complete search history.

(56) References Cited

U.S. PATENT DOCUMENTS

| | | | | |
|---|---|---|---|---|
| 2011/0212397 | A1* | 9/2011 | Aoki et al. | 430/108.6 |
| 2012/0056962 | A1* | 3/2012 | Takayama et al. | 347/179 |
| 2012/0306983 | A1* | 12/2012 | Mizutani et al. | 347/179 |
| 2012/0306985 | A1* | 12/2012 | Iguchi et al. | 347/179 |
| 2014/0192127 | A1 | 7/2014 | Arima | |
| 2014/0205339 | A1 | 7/2014 | Umetsu | |

* cited by examiner

*Primary Examiner* — Sophia S Chen
(74) *Attorney, Agent, or Firm* — Patterson & Sheridan, LLP

(57) ABSTRACT

According to one embodiment, an image forming apparatus includes a heating section that heats an image on a sheet formed of decolorable color material; an image forming section that transfers the image formed of the decolorable color material to the sheet; a diagnosis image generating section that instructs the image forming section to generate a diagnosis image formed of a predetermined image on a sheet; a control section that controls the heating section to switch a fixing temperature for fixing the image formed of the decolorable color material on the sheet to a decoloring temperature for decoloring the image formed of the decolorable color material on the sheet; and a first transporting route that transports the sheet on which the diagnosis image of the decolorable color material is formed through the image forming section to the heating section maintained at the decoloring temperature.

16 Claims, 10 Drawing Sheets

IMAGE FORMING APPARATUS AND DECOLORING APPARATUS

BACKGROUND

A decoloring apparatus that decolors an image on a sheet, which is printed by decolorable color material, includes a heating section that heats the image at a decoloring temperature or higher and a pressing section that comes into pressing contact with the heating section. As a result, the image of the decolorable color material is heated and pressed at the decoloring temperature thereof or higher by passing the sheet through a nip in which the heating section comes into pressed contact with the pressing section, and the image is decolored. The sheet in which the decoloring is performed is reused as a printing sheet. Decoloring means, in the context of this disclosure, changing the appearance of a colored image comprising a toner or the like, such that the toner or the like which constitutes an image which is visible to a human eye, becomes not readily visible to the human eye.

It is preferable that the image on the sheet be entirely decolored by the decoloring operation, but a portion of the image that is not decolored may remain.

Defects of the decoloring apparatus may be exemplified as one of causes of occurrence of the portions of the image not becoming decolored. As a defect of the decoloring apparatus, for example, a case where the pressure on the sheet carrying the image is not evenly distributed across as the sheet is passed through the nip may occur. If there is a portion in which the pressure of the nip is inadequate, the image coming into contact with that portion of the nip remains colored.

However, since the images, and the location and density of the images, that are printed on the sheets and are subjected to being decolored are generally different on each printed sheet, if sheets passing through the defective nip do not have images thereon in a region thereof passing through the defective nip, the defective decoloring of the sheet does not occur and the location in the nip of the defect of the decoloring apparatus cannot be determined.

Therefore, it is preferable that a state of a heating device which decolors the image of the decolorable color material printed on the sheet by heating and pressing the image, be capable of being evaluated.

DETAILED DESCRIPTION

In general, according to one embodiment, an image forming apparatus includes a heating section that heats an image on a sheet formed of a decolorable material; an image forming section that transfers the image formed by the decolorable material to the sheet; a diagnosis image generating section that instructs the image forming section to generate a diagnosis image formed of a predetermined image; a control section that controls the heating section to switch a fixing temperature for fixing the image formed of the decolorable material on the sheet to a decoloring temperature for decoloring the image formed of the decolorable color material on the sheet; and a first transporting route that transports the sheet on which the diagnosis image of the decolorable material is formed by the image forming section to the heating section switched to the decoloring temperature.

According to an embodiment, there is provided a decoloring apparatus that decolors an image on sheet formed of decolorable color material by a heating section heating the image, the apparatus including an image reading section that reads the image of the sheet; a first transporting path that transports the sheet fed from a feeding section to a sheet stacking section through the image reading section; a second transporting path that transports the sheet which has passed through the image reading section to the heating section and again transports the sheet to the image reading section; a control section that has a chart diagnosis mode in which mode it controls a process of decoloring a diagnosis sheet on which a diagnosis image composed of a decolorable image material formed of a predetermined image is printed, by heating the sheet having the image in the heating section and reading a secondary image after the decoloring is performed after transporting the decolored sheet to the image reading section; and an evaluation section that evaluates a state of the heating section based on reading of the secondary image.

First Embodiment

Figure 1:
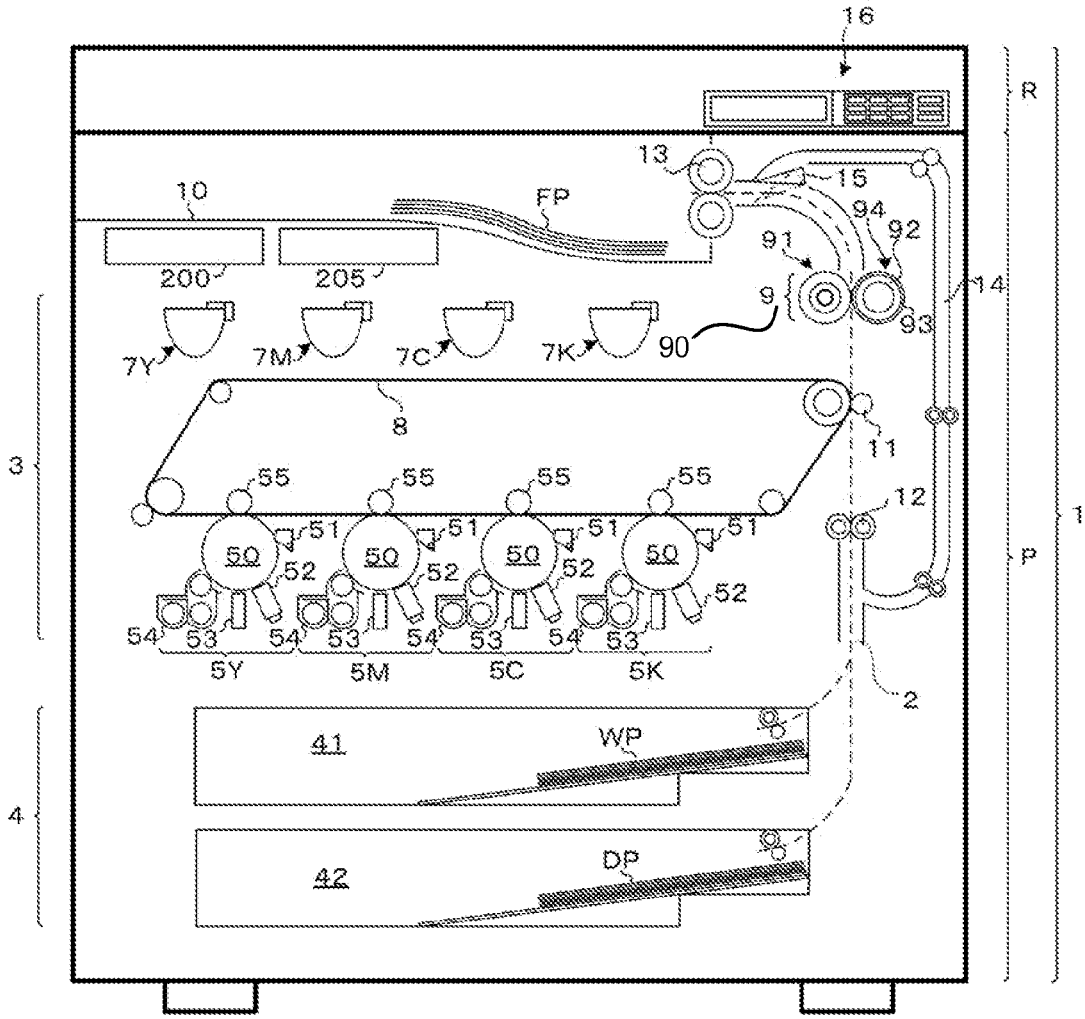
FIG. 1 is a schematic view of an image forming apparatus (MFP) according to a first embodiment.

FIG. 1 is a schematic view of an image forming apparatus (MFP) according to a first embodiment.

In FIG. 1, an MFP 1 that is the image forming apparatus has a printing function in which an unfixed decolorable toner image formed on a sheet is heated and thereby, and a decoloring function in which a decolorable toner image fixed on the sheet is decolored.

The MFP 1 includes a scanner section R that is an image reading device on an upper section of a printer section P. The printer section P includes an image forming section 3, a first feeding cassette 41 that stores print sheets WP, a second feeding cassette 42 that stores decoloring sheets DP on which the print is performed by the decoloring toner for decoloring.

The image forming section 3 includes process cartridges 5Y, 5M, 5C and 5K of each color of yellow (Y), magenta (M), cyan (C) and black (K), toner cartridges 7Y, 7M, 7C and 7K of each color, and a transfer belt 8 that is an image carrier. A photosensitive drum 50, a photosensitive cleaner 51, an electric charger 52, an exposure scanning head 53, and a developing device 54 are respectively disposed in the process cartridges 5Y, 5M, 5C and 5K for each color.

Decoloring toner is stored in the toner cartridges 7Y, 7M, 7C and 7K of each color, which when used is fixed by heating at a predetermined fixing temperature or higher and is decolored by heating at a decoloring temperature or higher that is higher than the fixing temperature.

Erasing a color of an image by decolorable color material with respect to the sheet on which the image is formed by the decolorable color material (decoloring color material) such as the decolorable toner (decoloring toner) or decolorable ink is referred to as a decoloring (an erasing process). The decolorable color material includes a coloring compound, a developer and a decolorant. For example, for the coloring compound, Leuco dye is exemplified. For example, as the developer, phenols may be exemplified. As the decolorant, a material that is compatible with the coloring compound when being heated, and has no affinity with the developer, may be exemplified. The decolorable color material is colored by an interaction between the coloring compound and the developer, and is decolored by cutting off the interaction between the coloring compound and the developer by heating the decolorable color material at the decoloring temperature or higher.

Further, the MFP 1 includes a heating section 9 that fixes an unfixed toner image transferred thereto on the sheet by applying heat and pressure thereto, and discharges an image-fixed sheet FP to a discharge tray 10. For example, the heating section 9 includes a heating roller 91 with a heater 90 built inside the roller and a pressing roller 94 in which an elastic body layer 93 that is configured of an elastic material such as sponge or rubber is formed on an outer peripheral section of a metallic roller body 92, and the pressing roller 94 which comes into pressing contact with the heating roller 91 to form a nip through which the sheet having an image to be fixed thereon is passed.

In the pressing roller 94, the elastic body layer 93 comes into pressing contact with an outer peripheral surface of the heating roller 91, and the sheet having the unfixed toner is inserted into a nip section between the elastic body layer 93 and the heating roller 91.

Further, a control section 200 controls the electricity supply to the heater 90 within the heating roller 91 and thereby a surface temperature of the heating roller 91 is switched between a fixing temperature and a decoloring temperature.

The image forming section 3 controls the exposure scanning head 53 of each color based on an image signal of a document image that was read by the scanner section R, and exposes light corresponding to the image of each color on the photosensitive drum 50 corresponding to each color. A latent image of the photosensitive drum 50 of each color is developed by the developing device 54 and the toner image is transferred to the transfer belt 8 moved therepast by a primary transfer roller 55.

The sheet WP fed from the first feeding cassette 41 is transported along a main transporting route 2 and is paused at a resist roller 12, and is further transported along the main transporting route at a time when the toner image on the transfer belt 8 is ready to be transferred at the location of a secondary transfer roller 11. The sheet WP to which the toner image is then transferred then passes through the nip section of the heating section 9 that functions as the fixing section. At this time, the toner image is heated and pressed by the heating roller 91 and the pressing roller 94, and thus is fixed on the sheet. The sheet FP to which the image is fixed is discharged to the discharge tray 10 by a discharge roller 13.

The MFP 1 includes a printing on both-sides of the sheet transporting route 14. In the both-side transporting route 14, a starting end of the transport path for the printing on the second side is disposed between the discharge roller 13 and the heating section 9, and in the main transporting route 2, the terminal end of the second side transporting path is connected downstream of the primary transport path upstream of the resist roller 12. Further, a flapper 15 switching the sheet transport path is disposed on the starting end side of transporting of the second side transporting route 14. The sheet transported in the main transporting route 2 which is guided toward and between the discharge rollers 13 is then guided to the second side transport path 14 by switching the flapper 15 between a position indicated in a solid line and a position indicated by the dashed line, and then reversing the travel direction of the sheet in the discharge roller 13 and thence into the second side transport route 14.

The sheet transferred in the both second transporting route 14 is transported to the main transporting route 2 and is again paused at the resist roller 12 until an image therefor is coordinated for transfer thereto at the transfer roller 11 location.

Selection of the decoloring operation may performed manually by operation of an operation section 16 or by automatic operation that is automatically operated, for example, when an image forming operation on a sheet is not accurately or completely performed. When the decoloring operation is selected with the manual operation or the automatic operation, the control section 200 performs the decoloring operation. The decoloring operation is performed by transporting a decoloring sheet DP stored in the second feeding cassette 42 to the heating section 9 through the resist roller 12 and the secondary transfer roller on the main transporting route 2. The heater 90 of the heating section 9 of the heating roller 91 is switched to the decoloring temperature and the toner image formed with the decoloring toner is decolored by being heated at the decoloring temperature.

A sheet WP that has been printed and that has passed through the heating section 9 is discharged to the discharge tray 10 by the discharge roller 13 for reuse. Here, since the heating section 9 heats the side of the heating roller 91 to the decoloring temperature, for example, when the images are formed on both surfaces of the decoloring sheet DP, the decolorable toner image on one surface side which directly comes into contact with the heating roller 91 is sufficiently heated, but the decolorable toner image on the back surface side may not be sufficiently heated. Thus, the sheet DP on which a first decoloring is completed is transported to the second-side transporting route 14 and may thus be passed through the heating section 9 again. Of course, the heating section 9 may be configured by providing the heater in the pressing roller. Further, two sets of the heating section 9 may be provided and one surface of the sheet may be heated by the heating roller of one heating section 9 and the back surface of the sheet may be heated by the heating roller of the other heating section 9.

In the embodiment, when performing the decoloring of the decoloring sheet DP, the cumulative number of sheets which have been decolored is counted and is stored in a storage section 205.

Figure 3:
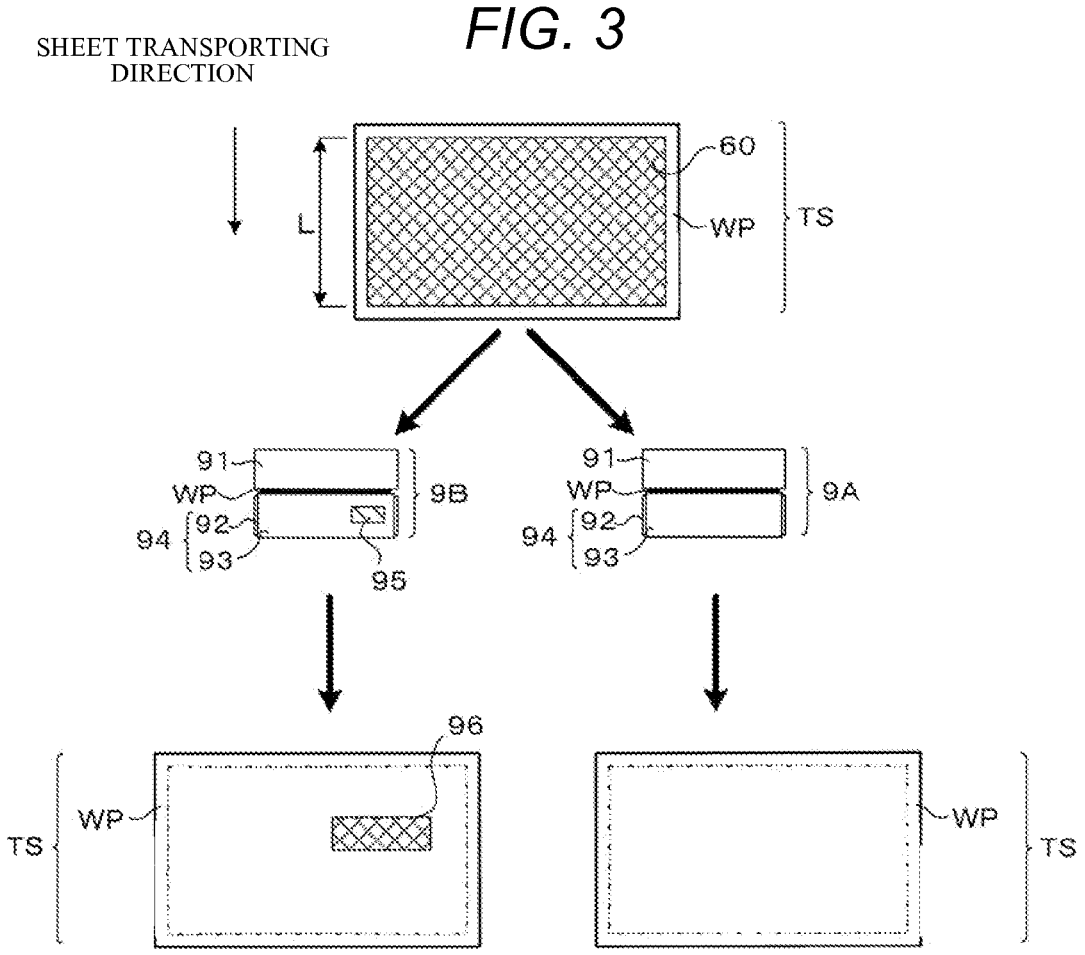
FIG. 3 is a view illustrating an evaluation method of the heating section.

When the cumulative number of sheets that have been decolored in the image forming apparatus 1 reaches the predetermined number, for example, 1000, the control section 200 instructs the image forming section 3 to print a diagnosis sheet for diagnosing the condition of the heating section 9, and as a result a diagnosis image 60 is formed on an unused sheet WP removed from the first feeding cassette 41 (see FIG. 3) for printing of the diagnosis image thereon. As illustrated in FIG. 3, as a diagnosis image 60, for example, a solid image of which an entire surface is printed at a uniform density or concentration of the decoloring toner of a single color is preferred. However, the diagnosis image 60 is not limited to the solid image and may be an image capable of diagnosing the heating state of the heating section 9. In the diagnosis image 60 that is unfixed and formed on the unused sheet WP, a length L, in the transporting direction of the sheet WP, is the same, or slightly longer than, the outer circumference of the heating roller 91.

In the embodiment, diagnosis images 60 are formed on the both surfaces of the sheet WP. Thus, first, the diagnosis image 60 of the one surface of the sheet WP is passed through, and become fixed by, the heating section 9 that is controlled to be at or above the fixing temperature, and the sheet is then transported to the second-side transport route 14. Then, the diagnosis image 60 is formed on the back surface of the sheet WP and is fixed by the heating section 9 to obtain a both-side printed diagnosis sheet TS. In order to perform a diagnosis of the heating section 9 providing the decoloring function, the diagnosis sheet TS on which the diagnosis images are printed on the both surfaces thereof by the decolorable toner is transported to the second-side transporting route 14 which causes the sheet to pass through the heating section 9 that is now set at the decoloring temperature.

One cause of the occurrence of portions of the sheet not becoming decolored is that a portion of the elastic body layer 93 configuring the pressing roller 94 of the heating section 9 has become damaged during decoloring operations and thus the sheet does not come into pressing contact with the heating roller 91 with a predetermined pressure in regions where the elastic body layer 93 thereof is damaged. In FIG. 3, a sheet passing through the heating section in a state where the elastic body layer 93 of the pressing roller 94 is not damaged and the sheet WP is pressed sufficiently across the entire surface thereof with a uniform pressure by the heating roller 91 is indicated in view 9A and a sheet passing through the heating section wherein the elastic body layer 93 of the pressing roller 94 has a damaged section 95 is indicated at 9B.

Here, if the heating section 9 through which the diagnosis sheet TS passes is the normal heating section 9A, the diagnosis image 60 is decolored across the entire surface thereof and no not decolored is present. That is, the heating section 9A may be diagnosed as normal.

Meanwhile, if the heating section 9 through which the diagnosis sheet TS passes is the heating section 9B that has a defect 95 in the elastic body layer 93, as illustrated in FIG. 3, a remaining not decolored section 96 is generated in a portion of the sheet WP coming into contact with the damaged section 95. Therefore, when it is confirmed that a not decolored section occurs in a portion of the diagnosis sheet TS, it is possible to diagnose that the decoloring defect is occurring in the heating section 9.

Figure 2:
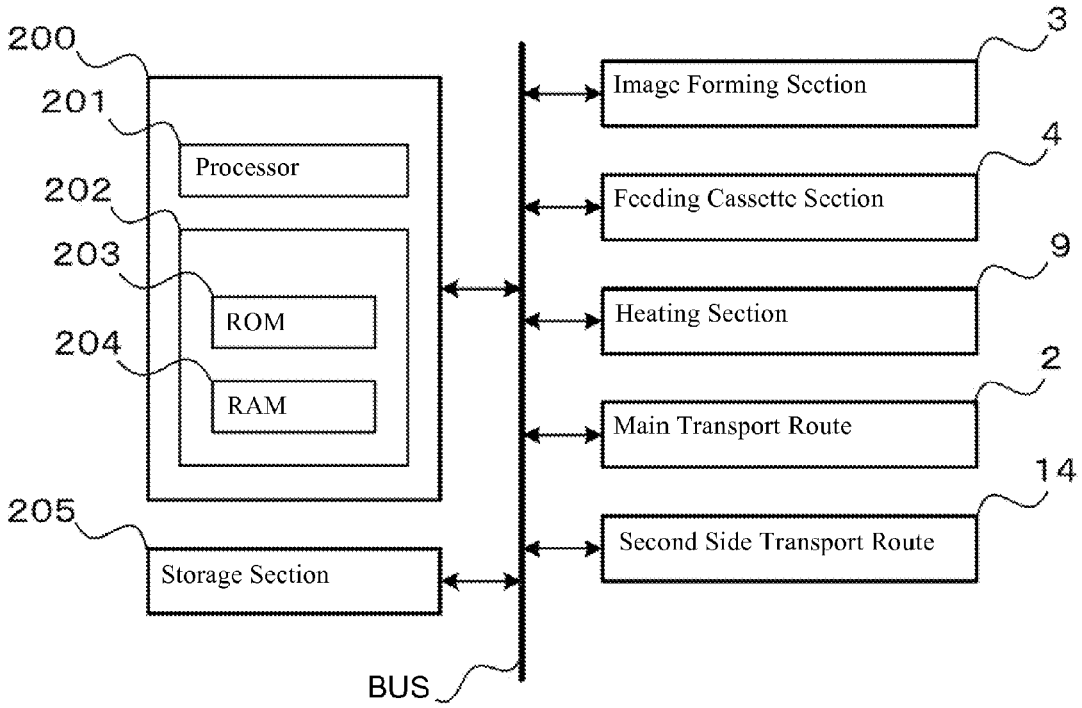
FIG. 2 is a block diagram illustrating a hardware configuration executing a diagnosis program of a heating section in the MFP in FIG. 1.

FIG. 2 is a block diagram illustrating a hardware configuration for executing a diagnosis program of the heating section.

In FIG. 2, the MFP 1 includes the image forming section 3 that forms the decolorable toner image, the heating section 9 that fixes the unfixed toner image at the fixing temperature and a decoloring function for decoloring by heating the decolorable toner fixed on a sheet, the main transporting route 2 that transports the print sheet WP and the decoloring sheet DP fed from a feeding cassette section 4, the second-side transport route 14, the feeding cassette section 4, the control section 200 that controls the entirety of the MFP 1, and the storage section 205.

The control section 200 performs a predetermined heating section diagnosis based on a heating section diagnosis program stored in a memory 202 or the storage section 205. For example, the control section 200 includes a processor 201 configured of a Central Processing Unit (CPU) or a Micro Processing Unit (MPU), and the memory 202. For example, the memory 202 is a semiconductor memory and includes a Read Only Memory (ROM) 203 storing various control programs and a Random Access Memory (RAM) 204 providing temporal working memory for the processor 201.

The diagnosis of the heating section 9 that is performed by the control section 200 is described with reference to FIG. 4.

In the diagnosis of the heating section 9 that is performed by the control section 200, the number of sheets which have been decolored after start up, or since the last diagnosis of the decoloring section 200, is counted in Act 1, and it is determined whether or not the number of sheets which have been decolored reaches the predetermined number. When reaching the predetermined number of sheets, it is automatically determined that the need for inspecting the heating section 9 in Act 2 has occurred.

In Act 2, when determining that the need for inspection of the heating section 9 has occurred, the process proceeds to Act 3.

In Act 3, the control section 200 determines whether or not the heating section 9 has reached the fixing temperature. When the number of sheets that have been decolored reaches the predetermined number (Yes in Act 2), the decoloring is temporarily stopped and the heating and pressing rollers are held in a stand-by state until the temperature drops to the fixing temperature because the heating section 9 was at the decoloring temperature that is higher than the fixing temperature.

In Act 4, the image forming section 3 is instructed to generate the diagnosis image 60 and the process proceeds to Act 5. For example, the diagnosis image 60 is a monochrome image of the darkest printable density or concentration and is formed by only the process cartridge 5K of the black, and is the image is transferred to the transfer belt 8.

In Act 5, a sheet WP stored in the first feeding cassette 41 is transported to the main transporting route 2 and the process proceeds to Act 6. In Act 6, the secondary transfer roller 11 transfers the diagnosis image 60 to the one surface of the sheet WP, which is transported by the resist roller 12, and the process proceeds to Act 7.

In Act 7, the diagnosis image 60 that is formed by the unfixed decoloring toner, which is transferred to the one surface of the sheet WP is fixed by heating and pressing in the heating section 9, and the process proceeds to Act 8.

In Act 8, the sheet WP which passed through the heating section 9 is transported to the second-side transport route 14 and the process proceeds to Act 9.

In Act 9, similar to Act 6, the diagnosis image 60 is transferred to the back surface of the sheet WP and the process proceeds to Act 10.

In Act 10, similar to Act 7, the diagnosis image 60 is fixed to the back surface of the sheet WP and the diagnosis sheet TS is formed, and the process proceeds to Act 11.

In Act 11, the heating section 9 is heated so as to reach the decoloring temperature from the fixing temperature and the process proceeds to Act 12.

In Act 12, the diagnosis sheet TS is transported to the second-side transport route 14 and the process proceeds to Act 13.

In Act 13, the transporting of the diagnosis sheet TS is paused at the resist roller 12 and the process proceeds to Act 14.

In Act 14, it is determined whether or not the temperature of heating section 9 has reached the decoloring temperature. When the control section 200 determines that the temperature of the heating section 9 has reached the decoloring temperature, the process proceeds to Act 15. Meanwhile, it is determined that the temperature of the heating section 9 does not has not reached the decoloring temperature (No in Act 14), the heating section 9 is continuously heated until reaching the decoloring temperature, which is higher than the fixing temperature.

In Act 15, the diagnosis sheet TS is transported to the heating section 9 at the decoloring temperature and the process proceeds to Act 16.

In Act 16, the diagnosis sheet TS which has passed through the heating section 9 is discharged to the discharge tray 10. The diagnosis sheet TS discharged to the discharge tray 10 passes through the heating section 9 and then the decoloring of the diagnosis image 60 is processed. It is possible to diagnose a state of the heating section 9 by whether or not a portion of the image which is not decolored exists in the diagnosis sheet TS. As a cause of a portion of the image which is not decolored remaining in the diagnosis image 60, for example, a case where damage occurs in a portion of the elastic body layer 93 of the pressing roller 94 or a case where the outer peripheral surface of the heating roller 91 cannot evenly come into pressed contact with the pressing roller 94 due to the deformation of the outer peripheral surface thereof may be the cause.

According to the embodiment, in the MFP 1 having both functions of the image formation and the decoloring of the image, upon reaching the need to inspect the heating section 9 based on the number of times decoloring has been performed, since the diagnosis sheet TS is automatically created, automatically passed through the heating section 9 having the decoloring temperature, and is discharged, it is possible to diagnose a state of the decoloring function of the heating section 9 by visual inspection of the diagnosis sheet TS by an operator.

Second Embodiment

Figure 5:
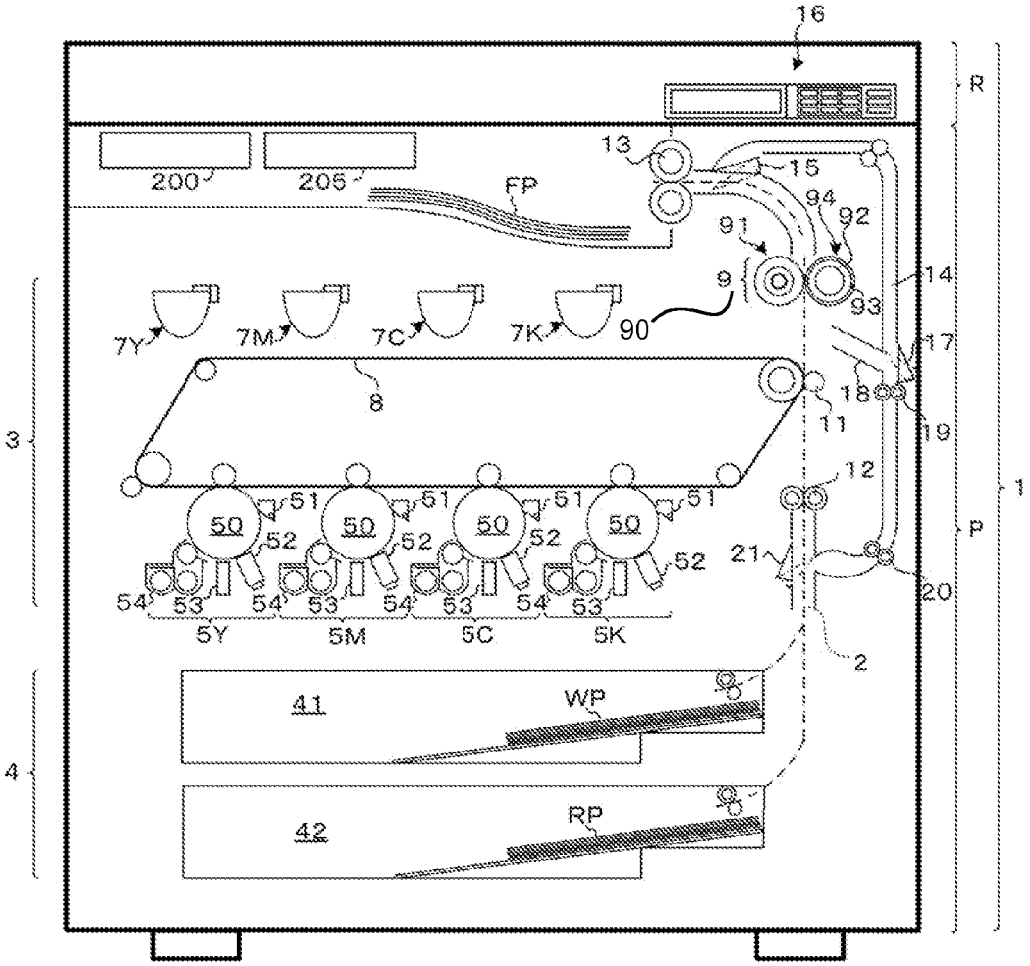
FIG. 5 is a schematic view of an image forming apparatus (MFP) according to a second embodiment.

FIG. 5 illustrates a second embodiment.

The second embodiment is a modified example according to the first embodiment. In FIG. 5, the same reference numerals are given to the same members or components as those illustrated in FIG. 1 and the description thereof is omitted.

The embodiment is different from the first embodiment in that a bypass transport route 18 is provided in the second-side transporting route 14. The bypass transport route 18 joins the main transporting route 2 between the secondary transfer roller 11 and the heating section 9. Further, in the second-side transporting route 14, transporting rollers 19 and transporting rollers 20, are disposed downstream (in a sheet flow path direction) from a branch section of the bypass transporting route 18, and are forwardly/reversely rotatable, and the sheet RP transported in the main transporting route 2 may be transported from the second-side transporting route 14 to the heating section 9 through the bypass transporting route 18. A flapper 21 is disposed at a juncture location at which the second-side transporting route 14 diverts from the main transporting route 2. When the flapper 21 is disposed in a position indicated by the solid lines, the sheet is transported from the feeding cassette section 4 directly to the resist roller 12, and when switched to the position indicated by dashed lines, the sheet RP from the second feeding cassette 42 is transported from the both-side transporting route 14 to the heating section 9 through the bypass transporting route 18.

Further, in the first embodiment, the diagnosis images are formed on both surfaces of the diagnosis sheet TS, but in a second embodiment, a diagnosis image 60 is formed only on one surface of a sheet. The diagnosis sheet TS on which the diagnosis image 60 is formed on only one surface thereof is transported in the second-side transport route 14 and when the trailing edge of the sheet TS reaches the transporting roller 19, the transporting of the transporting roller 19 and the transporting roller 20 is paused, and the diagnosis sheet TS is transported in the opposite direction while awaiting the heating section 9 reaching the decoloring temperature. At this time, the flapper 17 that is disposed in the joint section of the bypass transport route 18 is switched from a position indicated in a solid line to a position indicated in by the dashed lines, and the diagnosis sheet TS is then transported along the bypass transport route 18.

Then, the one surface of the diagnosis sheet TS on which the diagnosis image 60 is printed comes into contact with the heating roller 91 of the heating section 9 having achieved the decoloring temperature, and the decoloring of the diagnosis image 60 on the sheet TS is performed.

According to the embodiment, when the decoloring of the sheet RP is processed, since the sheet RP does not pass through the secondary transfer roller 11, it is not necessary to drive the image forming section 3 such as the transfer belt 8.

Further, also for the diagnosis sheet TS, the diagnosis image 60 is printed only one surface and it is possible to diagnose a state of the heating section 9 by using the bypass transporting route 18.

Third Embodiment

Figure 6:
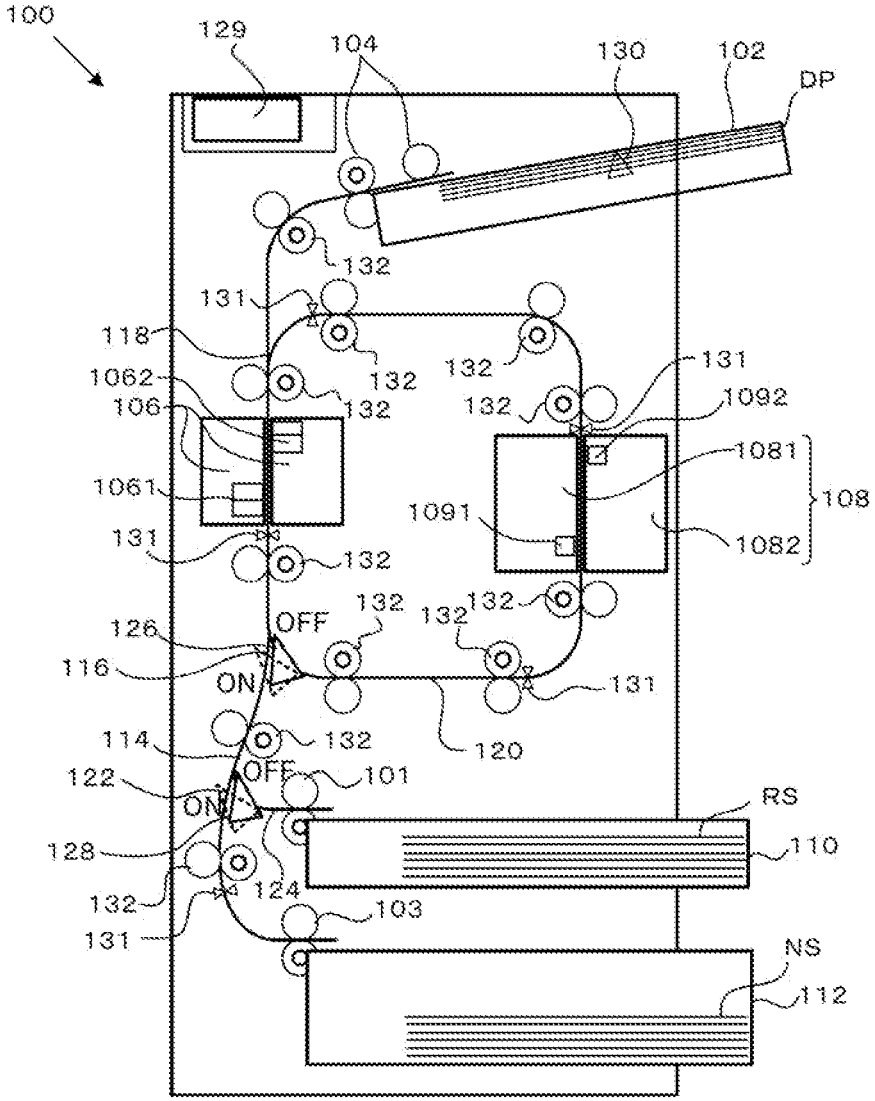
FIG. 6 is a schematic view of a decoloring apparatus according to a third embodiment.
Figure 7:
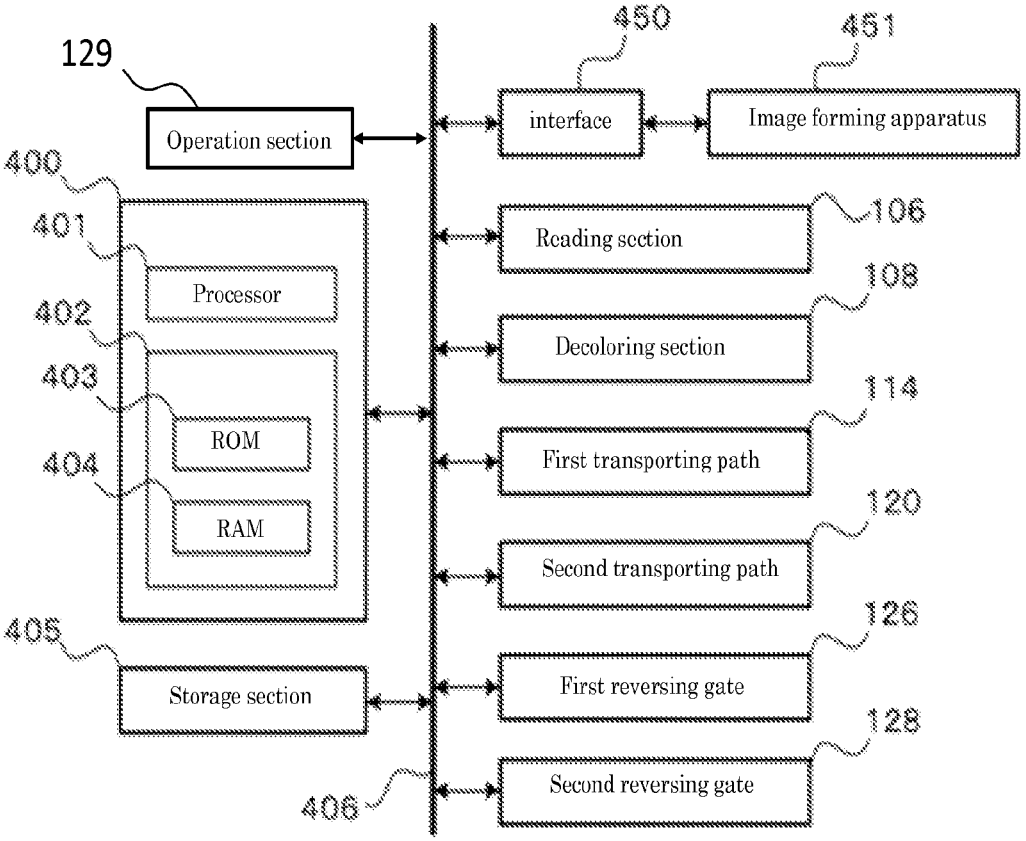
FIG. 7 is a block diagram illustrating a hardware configuration executing a diagnosis program of a decoloring section in the decoloring apparatus in FIG. 6.
Figure 8:
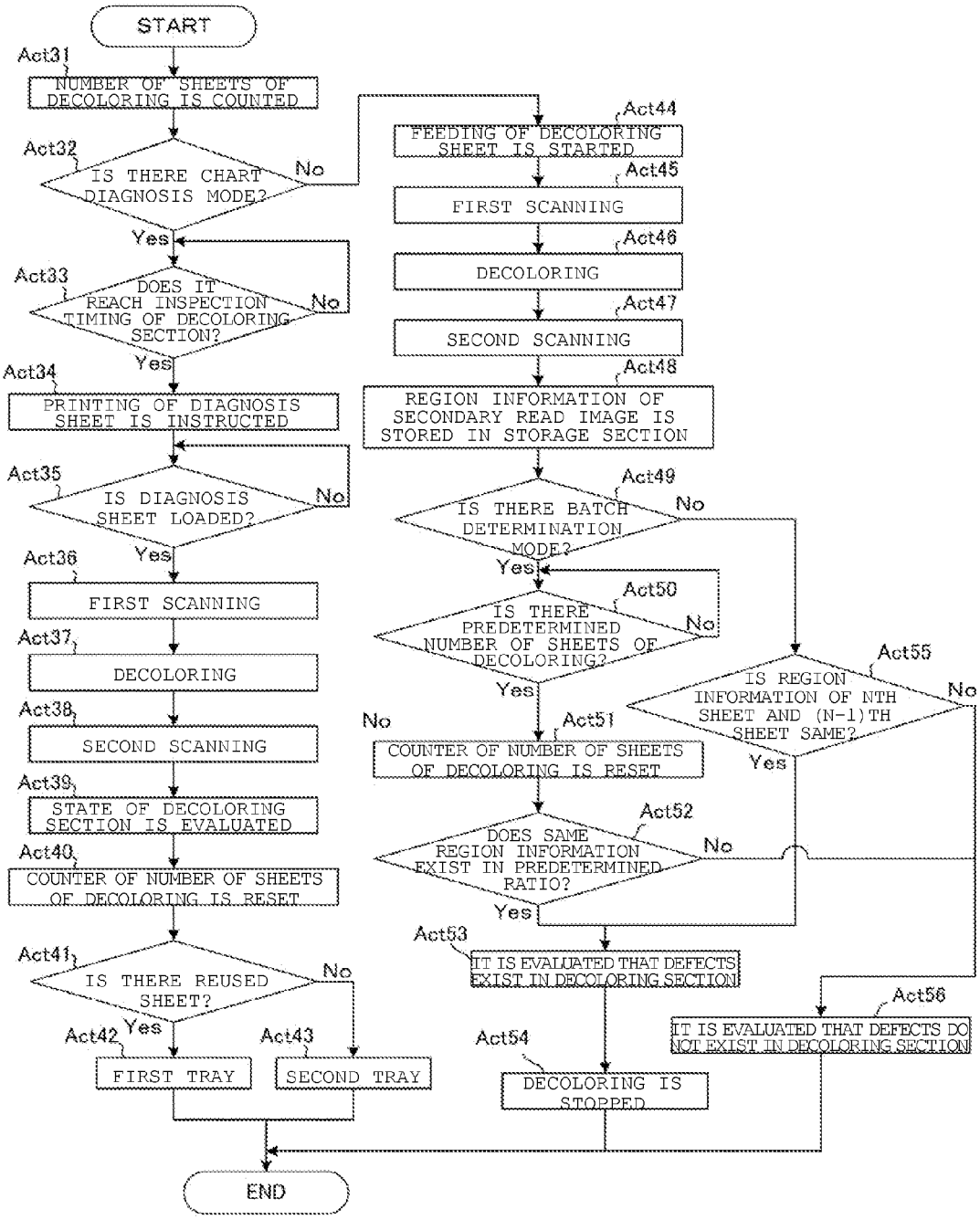
FIG. 8 is a flowchart executing the diagnosis program of the decoloring section by a hardware configuration in FIG. 7.

FIG. 6 is a view illustrating a configuration of a decoloring apparatus according to a third embodiment, FIG. 7 is a block diagram illustrating a hardware configuration for performing decoloring using the third embodiment and FIG. 8 is a flowchart of a diagnosing operation that diagnoses the condition of the decoloring section.

A decoloring apparatus 100 includes a feeding tray 102 in which decoloring sheets DP are loaded, a feeding member 104, a reading section 106 for a first surface that is one surface and a second surface that is a back surface of the sheet DP, a decoloring section 108, a first tray 110 to which reused sheets RS which are decolored sheets are supplied, and a second tray 112 to which rejected sheets NS which are sheets determined not to be capable of being reused are supplied. Further, the decoloring apparatus 100 includes a first transporting path 114 that transports the sheet from the feeding tray 102 to the second tray 112, a second transporting path 120 that is connected to the first transporting path 114 in a first branch point 116 and a joining point 118, and a third transporting path 124 that is branched from the first transporting path 114 at a second branch point 122 and supplies a sheet to the first tray 110. The second transporting path 120 transports the sheet transported from the first branch point 116 to the joining point 118.

Further, a first reversing gate 126 that is a first branch member is disposed in the first branch point 116 and allows the sheet transported in the first transporting path 114 to pass when it is in an OFF state, and when being switched (reversed) to an ON state indicated in a broken line, transports the sheet to the second transporting path 120. A second reversing gate 128 that is a second branch member is disposed in the second branch point 122 and allows the sheet transported in the first transporting path 114 to pass when it is in an OFF state and then cause the sheet to be supplied to the second tray 112. Further, when the second reversing gate 128 is switched (reversed) to an ON state indicated by a broken line, the sheet is transported to the third transporting path 124 and the sheet is supplied to the first tray 110.

The feeding tray 102 holds sheets DP of various sizes such as A4, A3 and B5. For example, the sheet that is loaded in the feeding tray 102 is a sheet on which the image is formed by the decolorable color material (recording material) that performs the decoloring by heating the sheet at a predetermined temperature or higher. The feeding member 104 includes a pickup roller, a sheet supply roller, a separation roller that is disposed opposite to the sheet supply roller and the like, and the sheet is supplied to the first transporting path 114 inside the decoloring apparatus 100 one by one from the uppermost position of the sheets loaded on the feeding tray 102.

Further, the feeding tray 102 includes a detection sensor 130 (hereinafter, referred to as a feeding start detection sensor) detecting presence or absence of the sheet on the feeding tray 102. For example, the feeding start detection sensor 130 may be a micro sensor or a micro actuator. When the feeding start detection sensor 130 detects the loading of the sheet, the loaded sheet is fed depending on which feeding mode is set. Feeding control by a control section 400 described below is described below.

The first transporting path 114 forms a transporting path from the feeding tray 102 to the second tray 112. The first transporting path 114 transports the sheet that is fed through the reading section 106.

The reading section 106 is disposed along the first transporting path 114 downstream of the feeding tray 102 in the sheet transporting direction. For example, the reading section 106 includes a reading unit such as a Charge Coupled Device (CCD) scanner or a CMOS sensor. In the embodiment, the reading section 106 reads each image of the first surface and the second surface of the sheet that is transported. That is, the reading section 106 is configured of a first reading unit 1061 and a second reading unit 1062 which are disposed along the first transporting path 114 and across the transporting path, and are capable of reading images on both surfaces of the sheet that is transported therethrough.

A position in which the reading unit of the reading section 106 reads the image of the sheet is referred to as a reading position. The image that is read by the reading section 106 is stored in a storage section 405 (see FIG. 7) described below. For example, the image is stored in the storage section 405 by digitizing the image on the sheet that is read by the reading section 106 before performing the decoloring thereof and thereby it is possible to acquire image data when the data of the image that was decolored is required later. Further, the control section 400 described below determines whether or not the sheet is capable of being decolored or is capable of being reused based on the image that is read by the reading section 106.

The first reversing gate 126 as a switching section is located downstream of the reading section 106. The first reversing gate 126 switches the transporting direction of the sheet that is transported. The first reversing gate 126 transports the sheet that is transported in the first transporting path 114 to the second transporting path 120 or in the direction of the first and second trays 110, 112. The second transporting path 120 is branched from the first transporting path 114 at the branch point 116 at which the first reversing gate 126 is disposed. The second transporting path 120 that is branched from the branch point 116 transports the sheet to the decoloring section 108.

Further, the second transporting path 120 joins the first transporting path 114 at the joining point 118 upstream of the reading section 106 in the sheet transporting direction. That is, the second transporting path 120 joins the first transporting path 114 at the joint point 118 between the feeding tray 102 and the reading section 106. Therefore, the second transporting path 120 may transport the sheet DP that is transported from the reading section 106 to the reading section 106 again through the decoloring section 108. In other words, the decoloring apparatus 100 may transport the sheet that is supplied from the feeding member 104 to the reading section 106, the decoloring section 108 and the reading section 106 in order by controlling the position (ON and OFF) of the first reversing gate 126.

The first transporting path 114 includes the second reversing gate 128 on the downstream of the first reversing gate 126. The second reversing gate 128 guides the sheet that is transported from the first reversing gate 126 to the second tray 112 or the third transporting path 124. The third transporting path 124 transports the sheet to the first tray 110.

The decoloring section 108 decolors the color of the image of the sheet that is transported. For example, the decoloring section 108 decolors the color of the image formed on the sheet by the decolorable color material by heating the sheet to a predetermined decoloring temperature in a state of coming into contact with the sheet that is transported. For example, the decoloring section 108 of the decoloring apparatus 100 according to the embodiment includes two decoloring units 1081 and 1082 for decoloring the first surface and the second surface of the sheet. For example, the decoloring units 1081 and 1082 may have the same configuration as that of the heating section 9 illustrated in FIG. 1. Of course, the configuration thereof is not limited to the configuration of the heating section 9. For example, the configuration thereof may be a configuration illustrated in FIG. 10 described below.

The decoloring units 1081 and 1082 are disposed opposite to each other across the second transporting path 120. The decoloring unit 1081 heats the sheet by coming into contact with the sheet from the one surface side of the sheet. The decoloring unit 1082 heats the sheet by coming into contact with the sheet from the other surface side of the sheet. The decoloring section 108 includes temperature sensors 1091 and 1092 which detect the temperature of the heating rollers of the decoloring units 1081 and 1082, respectively. The temperature sensors 1091 and 1092 may be a contact type or a non-contact type temperature sensor.

An operation section 129 disposed in an apparatus body of the decoloring apparatus 100 includes a touch panel type display section and various operation keys, and, for example, is disposed on an upper section of the decoloring apparatus body. The operation keys include, for example, a numeric keypad, a stop key, a start key and the like.

In the embodiment, the sheet that is loaded on the feeding tray 102 is fed depending on the feeding mode that is set described below. In addition to the setting operation of the feeding mode described above by the operation section 129, a user instructs a functional operation of the decoloring apparatus 100 such as start of decoloring or reading of the image of the sheet on which the decoloring is performed. The operation section 129 displays setting information or operational status of the decoloring apparatus 100, log information or a message to the user.

Moreover, the operation section 129 is not limited to being disposed in the body of the decoloring apparatus 100. For example, a configuration may be adapted which may operate the decoloring apparatus 100 from an operation section of an external device connected to the decoloring apparatus 100 through a network. Alternatively, the operation section is in a form independent from the body of the decoloring apparatus and a configuration may be adapted which operates the decoloring apparatus 100 by wired or wireless communication. The operation section according to the embodiment may be used as long as instructions of the processing or viewing of the information may be performed with respect to the decoloring apparatus 100.

Discharge rollers 101 and 103 discharge the sheet to the first tray 110 and the second tray 112 and are disposed on upper and lower portions in a lower section of the body after the decoloring processes. For example, the first tray 110 receives sheets RS on which the image is decolored and are reusable. The second tray 112 receives sheets NS which are determined not to be reusable. Hereinafter, the first tray 110 is referred to as a reuse tray and the second tray 112 is referred to as a reject tray. In FIG. 6, the reuse tray 110 is located above the reject tray 112. However, in other instances, the locations of the reuse tray 110 and the reject tray 112 may be switched so that the reuse tray 110 is located under the reject tray 112.

The decoloring apparatus 100 includes a plurality of sheet detection sensors 131 detecting the sheets which are transported in the first to third transporting paths 114, 120, and 124. For example, the sheet detection sensors may be a micro sensor or the micro actuator. The sheet detection sensors 131 are disposed at an appropriate position of the transporting paths. Further, transporting rollers 132 are appropriately disposed in the transporting paths.

FIG. 7 is a block diagram illustrating a hardware configuration of the decoloring apparatus 100. The decoloring apparatus 100 includes the control section 400, the storage section 405, the first transporting path 114, the second transporting path 120, the reading section 106, the decoloring section 108, the operation section 129, the first reversing gate 126, and the second reversing gate 128. Components of the decoloring apparatus 100 are connected to each other through a bus 406.

The control section (controller) 400 includes a processor 401 configured of a Central Processing Unit (CPU) or a Micro Processing Unit (MPU), and a memory 402. The control section 400 controls the reading section 106, the decoloring section 108, the operation section 129, the first transporting path 114, the second transporting path 120, the first reversing gate 126, and the second reversing gate 128.

For example, the memory 402 is a semiconductor memory and includes a Read Only Memory (ROM) 403 that stores various control programs, and a Random Access Memory (RAM) 404 that provides a temporal working region to the processor 401. For example, the ROM 403 stores a printing rate of the sheet that is a threshold of reusability, and a concentration threshold for determining whether or not the image is decolored.

Further, the cumulative number of sheets which have been decolored is recorded in the storage section 405 and the predetermined number of decolored sheets corresponding to the inspection timing of the decoloring section 108 is stored in the ROM 403. When the cumulative number of decolored sheets reaches the predetermined number, further decoloring is stopped and the fact that diagnosis of the decoloring section 108 is starting is displayed on the operation section 129. For diagnosing the decoloring section 108, the diagnosis sheet TS illustrated in FIG. 3 that is pre-printed with the decolorable color material.

Moreover, the control section 400 is connected to an image forming apparatus 451 through an interface (I/F) 450 and instructs the image forming apparatus 451 to print the diagnosis sheet TS when reaching the diagnosis timing. In this case, the image forming apparatus 451 prints the diagnosis image 60 on the sheet WP with the decolorable color material. A mode that instructs the image forming apparatus 451 to print the diagnosis sheet TS is referred to as a diagnosis sheet print instruction mode and it is possible to select whether or not the diagnosis sheet print instruction mode is selected by the operation of the operation section 129. When the mode is not selected, the fact that it reaches the diagnosis timing is displayed on the operation section 129.

Figure 9:
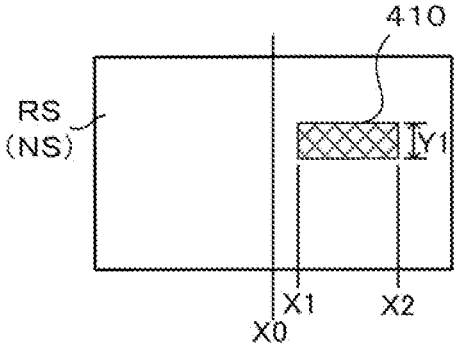
FIG. 9 is a view illustrating region information.

Further, region information of the image on the sheet that is read after performing the decoloring thereof is recorded in the storage section 405. For example, as illustrated in FIG. 9, the transporting direction of the sheet is a Y axis direction and a direction orthogonal to the transporting direction of the sheet, that is, an axial direction of the heating roller and the pressing roller is an X axis direction. Here, when a not decolored portion of the image 410 remains on the sheet RS (NS) which has been decoloring processed, when the coordinate of the center position of the sheet in the X axis direction is X0, coordinates of the not decolored image 410 portion in the X axis direction are X1 and X2, and a length of the not decolored image 410 portion in the Y axis direction is Y1. The x coordinate information and length information of the not decolored image 410 portion are recorded as the region where the image 410 did not decolor.

As illustrated in FIG. 3, for example, if the pressure is unevenly applied to the heating section 9, it causes lower or no pressure applied to the sheet portion to not be decolored. After the decoloring section 108 has decolored a certain number of sheets, subsequent sheets subject to the decoloring may have portions with residual images that have not been sufficiently decolored. In such an instance, the control section 400 determines that the decoloring section 108 has a problem, such as, for example, pressure unevenness. This determination is referred to as a batch determination mode.

Further, for printed sheets which are decoloring processed, when the not decolored image region continuous to occur on a plurality of sheets, it is possible to determine that, for example, a defect such as pressure unevenness occurs in the decoloring section 108 when the region of the remaining image is the same from sheet to sheet (the determination mode is referred to a continuous determination mode). A mode diagnosing a state of the decoloring section 108 based on the region where the not decolored portion of the image is present is referred to as a self diagnosis mode and a mode diagnosing a state of the decoloring section 108 by using the diagnosis sheet TS is referred to as a chart diagnosis mode.

The diagnosing operation diagnosing a state of the decoloring section 108, which is performed by the control section 400, is described based on the flowchart illustrated in FIG. 8. Moreover, a case where the diagnosis sheet print instruction mode that instructs the image forming apparatus 451 to print the diagnosis sheet TS is selected is described as an example.

In Act 31, the number of sheets having been decolored is counted and the process proceeds to Act 32.

In Act 32, when it is determined that the chart diagnosis mode is selected (NO of Act 32), the process proceeds to Act 33 and when the self diagnosis mode is selected, the process proceeds to Act 44.

In Act 33, when the number of decolored sheets reaches the preselected number of decolored sheets as which inspection of the decoloring section 108 is begun, the process proceeds to Act 34. In the embodiment, when the number of decolored sheets reaches the predetermined number of sheets that is set in advance in a counter counting the number of sheets of the decoloring, the diagnosis of the condition of the decoloring unit is started.

In Act 34, the printing of the diagnosis sheet TS is instructed to the image forming apparatus 451 and the process proceeds to Act 35. Here, the diagnosis sheet TS on which the printing is performed in the image forming apparatus 451 is loaded on the feeding tray 102 of the decoloring apparatus 100 by an operator. At this time, blank sheets which are unused are loaded by being superimposed on the diagnosis sheet TS. In the embodiment, the blank sheet is transported after the diagnosis sheet TS. Moreover, the blank sheet may be transported before the diagnosis sheet TS.

In Act 35, when detecting the load of the sheet by the sensor 130, first, the diagnosis sheet TS is transported to the first transporting path 114. The start of the transporting of the sheet is performed automatically or by the operation of the operation section 129 and the process proceeds to Act 36.

In Act 36, a first scanning step that reads the diagnosis images 60 printed on both surfaces of the diagnosis sheet TS by the reading section 106 is performed and the process proceeds to Act 37. The confirmation that the diagnosis sheet TS is transported is performed by the first scanning. Then, the diagnosis sheet TS is transported to the second transporting path 120.

In Act 37, the diagnosis sheet TS is transported to the decoloring section 108 and the decoloring of the diagnosis image 60 is processed, and the process proceeds to Act 38. The diagnosis sheet TS which has passed through the decoloring section 108 is transported from the second transporting path 120 to the first transporting path 114.

In Act 38, a second scanning is performed with respect to the diagnosis sheet TS in the reading section 106 and the process proceeds to Act 39. In Act 38, both surfaces of the diagnosis sheet TS of which decoloring is processed are read and a read image (a secondary read image) after the decoloring processes is recorded in the storage section 405.

In Act 38, when completing the second scanning with respect to the diagnosis sheet TS, the blank sheet loaded on the feeding tray 102 is transported to the first transporting path 114. Then, both surfaces of blank sheet are read in the reading section 106 and the read image is recorded in the storage section 405. When the read image includes an image other than a blank image (referred to as an abnormal image), it is determined that a defect has occurred in the reading section 106. When a direction orthogonal to the transporting direction of the sheet is a main scanning direction, positional information in the main scanning direction of the abnormal image is obtained.

In Act 39, the state of the decoloring section 108 is evaluated based on the read image after the decoloring is processed and the process proceeds to Act 40. If the image visible in the secondary read image after the decoloring is performed exists, it is possible to confirm that defects occur in the decoloring section 108, and if the image visible in the secondary read image after the decoloring is processed does not exist, it is possible to confirm that the decoloring section 108 is normal. Evaluation results are displayed on the operation section 129.

Here, if the abnormal image exists from a result of the reading of the blank sheet, the abnormal image is compared to the secondary read image of the diagnosis sheet TS after the decoloring is processed. Then, when the image other than the abnormal image exist in the secondary read image, it is possible to confirm that defects occur in the decoloring section 108. Further, when the image other than the abnormal image does not exist in the secondary read image, it is possible to confirm that defects do not occur in the decoloring section 108. That is, the abnormal image is compared to the secondary read image of the sheet TS and if the abnormal image exists in the secondary read image, for example, it is possible to determine that the abnormal image is noise occurring in the reading section 106 or the like. Moreover, for the determination whether or not the noise occurring in the reading section 106 or the like exists in the secondary read image of the sheet TS, the secondary read image may be compared to the image in which no abnormality occurs rather than compared to the abnormal image.

In Act 40, the counter of the number of sheets having been decolored is reset to zero and the process proceeds to Act 41.

In Act 41, it is determined whether the evaluation sheet TS is reusable or not-reusable based on the image thereof made after the decoloring process and stored in the storage section 405. If it is the reused sheet RS, the process proceeds to Act 42 and the reused sheet RS is transported to the first tray 110 and if it is the rejected sheet NS, the process proceeds to Act 43 and the rejected sheet NS is transported to the second tray 112, and the process is completed.

Meanwhile, In Act 32, when the self diagnosis mode is selected (No of Act 32), in Act 44, feeding of the decoloring sheet DS is started and the process proceeds to Act 45.

In Act 45, the images of both surfaces of the decoloring sheet DS are read by the reading section 106 and the read image is recorded in the storage section 405, and the decoloring sheet DS is transported to the second transporting path 120 and the process proceeds to Act 46.

In Act 46, decoloring is performed on both surfaces of the decoloring sheet DS by heating and pressing, and the sheet in which the decoloring is processed is transported to the first transporting path 114 and the process proceeds to Act 47.

In Act 47, secondary scanning is performed with respect to the sheet was decolored, the read image (hereinafter, referred to as the secondary read image) is recorded in the storage section 405, and the process proceeds to Act 48.

In Act 48, for example, as illustrated in FIG. 9, the coordinate information is recorded in the storage section 405 as the region information and the process proceeds to Act 49 based on the secondary read image recorded in the storage section 405. Moreover, the region information may be only the X coordinate.

In Act 49, if evaluation mode of the decoloring section 108 is the batch determination mode, the process proceeds to Act 50, and if it is determined that the evaluation mode is not the batch determination mode (NO of Act 49), the continuous determination mode is determined and then the process proceeds to Act 55.

In Act 50, when the value of the number of decolored sheets in the counter reaches the predetermined number of sheets, the process proceeds to Act 51 and the counter of the number of sheets of the decoloring is reset and then the process proceeds to Act 52.

In Act 52, it is determined whether or not an image remains in the same region in a predetermined ratio (or the predetermined number) of the images recorded in the storage section 405, and when the predetermined ratio exists, the process proceeds to Act 53 and when the predetermined ratio does not exist, the process proceeds to Act 56.

In Act 54, if defects occur as a result of decoloring, the occurrence of the defects is displayed on the operation section 129 and the decoloring is stopped, and the process is completed. Moreover, determination whether or not it the evaluated sheet is a reusable sheet RS is performed until the decoloring is stopped, and the sheet is transported to the first tray 110 or the second tray 112 depending on the determination result.

In the case of the continuous determination mode, in Act 55, for the region information of the secondary read image that is recorded in the storage section 405, the region information of the secondary read image of the sheet (nth sheet) that is read at this time is compared to the region information of the secondary read image of the sheet ((n−1)th sheet) that is read at previous time, and if it is the same or is similar to each other, the process proceeds to Act 53, and if it is not the same or is not similar to each other, the process proceeds to Act 56. That is, if the not decolored continuously exists at the same portion in the X axis direction, it is assumed that the defects occur in the decoloring section 108.

Moreover, in the embodiment, a case where the not decolored region of the image continuously exists in the same portion in two sheets in the X axis direction is described as an example, but if the not decolored region continuously exists in the same region portion in three sheets or more, it may be evaluated that the decoloring section 108 is defective.

In Act 56, since the not decolored region does not continuously occur in the same portion in the X axis direction, it is confirmed a defect is not present in the decoloring section 108 and the decoloring of the decoloring sheet DS is continued and the process is completed.

Fourth Embodiment

Figure 10:
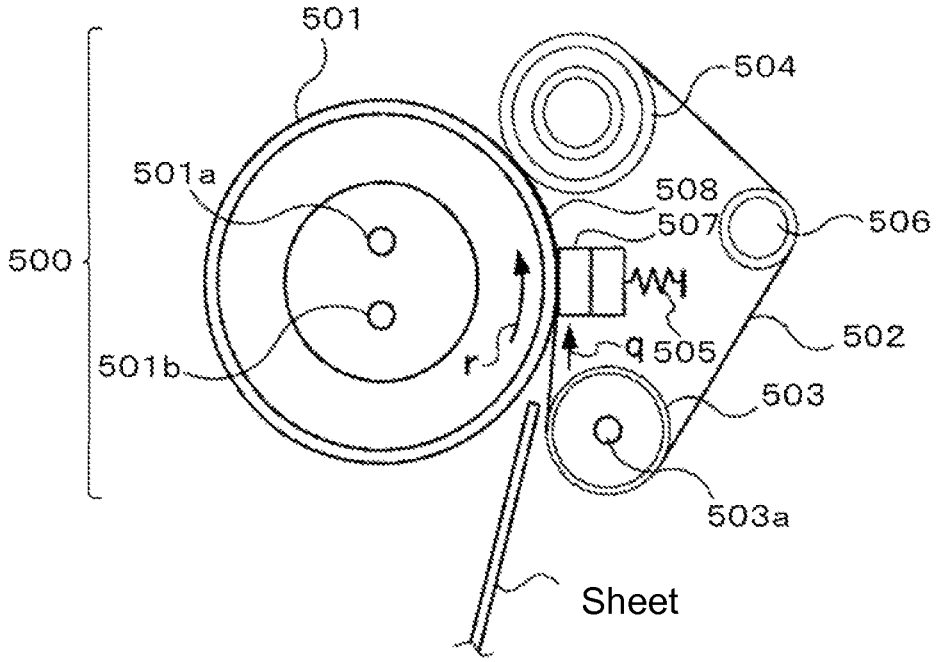
FIG. 10 is a schematic view of a heating device according to a fourth embodiment.

FIG. 10 is a schematic view of a heating device according to a fourth embodiment.

A heating device 500 may be used as the fixing device and the decoloring apparatus of the image forming apparatus 1 illustrated in FIG. 1, and may be used as the decoloring section 108 of the decoloring apparatus 100 illustrated in FIG. 6.

For example, the heating device 500 includes a heat roller 501 and an endless pressing belt 502. For example, the heat roller 501 has two halogen lamps 501*a* and 501*b* built therein. As illustrated in the view, the pressing belt 502 is tensioned by a belt heat roller 503 including a halogen lamp 503*a*, an outlet roller 504 and a tension roller 506. A nip pad 507 that is biased by a spring 505 is disposed inside a loop of the pressing belt 502. The nip pad 507 presses the pressing belt 502 from the inside of, to an outer peripheral surface of, the heat roller 501. The nip pad 507 forms a nip 508 between the heat roller 501 and the outer peripheral surface of the pressing belt 502.

The heating device 500 transports the sheet by being interposed between the heat roller 501 rotating in a direction of an arrow r and the nip 508 of the pressing belt 502 rotating in a direction of an arrow q. The heating device 500 fixes the unfixed toner image on the sheet by heating and pressing the sheet in a printing mode and decolors the image by heating the image on the sheet printed with the decolorable color material when in a decoloring mode.

Figure 4:
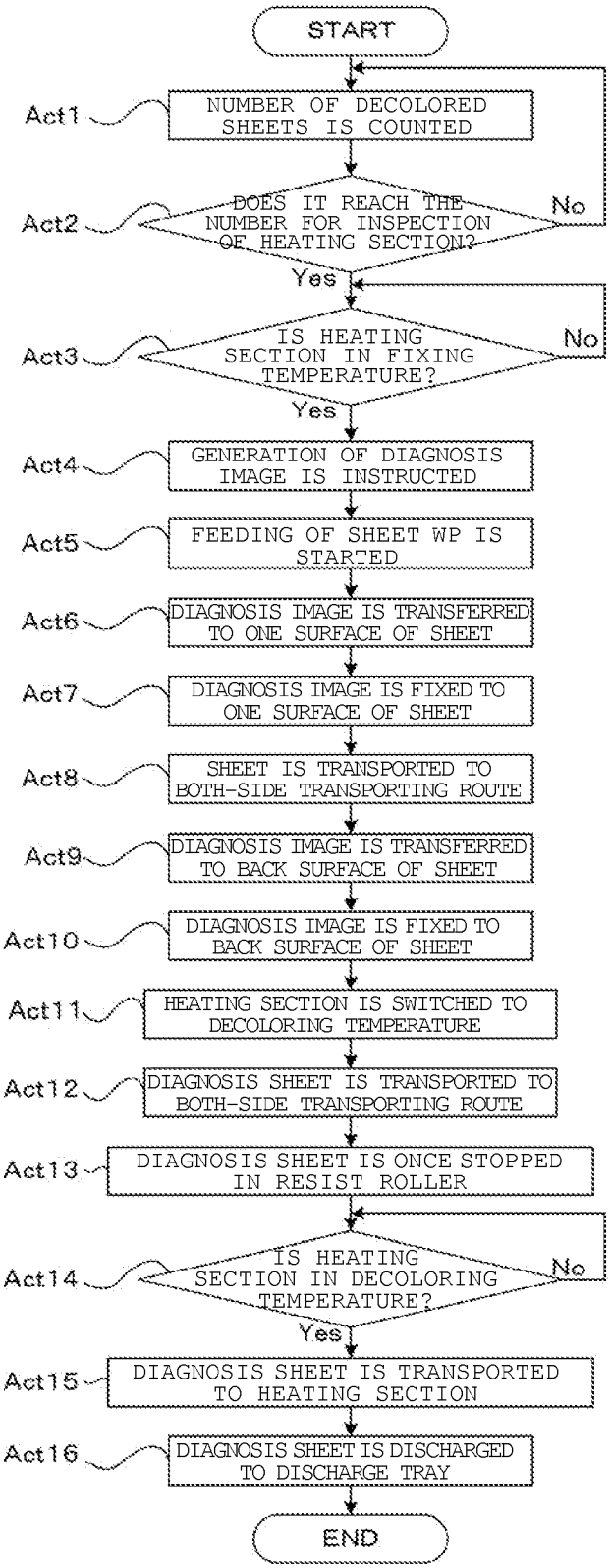
FIG. 4 is a flowchart executing the diagnosis program of the heating section by a hardware configuration in FIG. 3.

The process described in FIGS. 4 and 8 exemplifies a case where a processor for the internal data executes the program stored in advance in the storage region provided in the MFP 1 and the decoloring apparatus 100, but the program may be downloaded from a network to the MFP 1 and the decoloring apparatus 100, and a computer readable recording medium in which the program is stored may be installed in the MFP 1 and the decoloring apparatus 100. The recording medium may be used as long as the recording medium may store the program and is the computer readable medium. As the recording medium, for example, a Random Access Memory (RAM), a Read Only Memory (ROM), DRAM, a Static Random Access Memory (SRAM) a Video RAM (VRAM), and a flash memory may be used.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a heating section configured to heat an image on a sheet formed of decolorable color material;

an image forming section configured to form the image on the sheet;

a control section configured to control the heating section to set a temperature thereof to a fixing temperature for fixing the image formed of the decolorable color material on the sheet and a decoloring temperature for decoloring the image formed of the decolorable color material and fixed on the sheet, and control the image forming section to form a diagnosis image with the decolorable color material on a diagnosis sheet; and a first transporting section configured to transport the diagnosis sheet on which the diagnosis image is formed by the image forming section through the heating section which is at the decoloring temperature.

2. The apparatus according to claim 1, further comprising:

a second transporting section configured to transport the diagnosis sheet on which the diagnosis image is formed by the image forming section to the heating section for fixing by the heating section and then to the first transporting section.

3. The apparatus according to claim 2, wherein the control section is configured to control the image forming section to form the diagnosis image on the diagnosis sheet after a predetermined number of sheets on which an image of the decolorable color material is printed have been subjected to a decoloring process in the heating section.

4. The apparatus according to claim 2, further comprising a bypass guide that guides a sheet from a sheet path along which the second transport section transports a sheet to an intermediate position of a sheet path along which the first transport section transports a sheet.

5. The apparatus according to claim 1, further comprising:

an imaging section configured to read a surface on the diagnosis sheet on which the diagnosis image has been formed after the diagnosis sheet passes through the heating unit which is at the decoloring temperature, wherein the control section is further configured to determine whether or not an image remains on the diagnosis sheet, based on the read surface.

6. A decoloring apparatus that performs a decoloring process of an image of decolorable color material printed on a sheet by a heating section heating the image, the apparatus comprising:

an image reading section configured to read a surface on the sheet on which the image has been formed;

a first transporting section configured to transport the sheet fed from a feeding section to a sheet stacking section through the image reading section in a sheet transporting direction;

a second transporting section configured to transport the sheet passing through the image reading section to a position upstream with respect to the image reading section in the sheet transporting direction through the heating section, such that the first transporting section transports again the sheet through the image reading section;

a control section configured to operate in a chart diagnosis mode in which the control section controls a diagnosis decoloring process of a diagnosis sheet on which a diagnosis image of decolorable color material is printed in the heating section, controls the image reading section to read a surface of the diagnosis sheet transported thereto after the decoloring process has been performed, and evaluates a state of the heating section based on the reading result of the surface.

7. The apparatus according to claim 6, wherein the control section is further configured to compare a surface of a blank sheet read by the image reading section with the reading result.

8. The apparatus according to claim 7, further comprising:

a display section configured to display evaluated state of the heating section.

9. The apparatus according to claim 6, wherein the control section is configured to operate in the chart diagnosis mode after a predetermined number of sheets on which the image of the decolorable color material printed have been subjected to the decoloring process in the heating section.

10. The apparatus according to claim 6, wherein the control section is further configured to operate in a continuous diagnosis mode, in which the control section controls a process of storing images of sheets read in the image reading section, after the decoloring process, in a storage section and continuously diagnosing a state of the heating section based on the images stored in the storage section.

11. The apparatus according to claim 10, wherein the continuous diagnosis mode has a batch determination mode in which the control section determines that the heating section is defective if an image remains in the same region in a plurality of sheets subjected to the decoloring process in a predetermined ratio when a number of sheets subjected to the decoloring process reaches a predetermined number.

12. The apparatus according to claim 10, wherein the continuous diagnosis mode has a continuous determination mode in which the control section determines that the heating section is defective if an image remains in the same region of sheets that are continuously subjected to the decoloring process.

13. A method of evaluating a condition of a heating portion of an image processing apparatus configured to decolor an image formed of a decolorable toner on a sheet, comprising:

providing a diagnosis image on both sides of a diagnosis sheet with the decolorable toner in a diagnosis mode;

passing the diagnosis sheet having the diagnosis images thereon past the heating portion of the image processing apparatus while the heating portion is maintained at a decoloring temperature of the decolorable toner or higher;

imaging both sides of the diagnosis sheet after the diagnosis sheet is passed through the heating portion of the image processing apparatus while the heating portion is maintained at the decoloring temperature of the decolorable toner or higher; and determining a presence of a defect in the heating portion based upon a presence of a portion of the diagnosis image remaining on at least one side of the diagnosis sheet.

14. The method according to claim 13, wherein the heating portion includes a roller configured to be heated to the decoloring temperature of the decolorable toner, and a nip is formed between the roller and another moving surface.

15. The method according to claim 13, further comprising:

in a batch determination mode different from the diagnosis mode, continuously imaging sheets that have been subjected to a decoloring process by the heating portion;

counting a number of sheets having a readable image thereon after the decoloring process;

comparing the counted number to a preselected number; and determining that the heating portion is defective if the counted number reaches the preselected number.

16. The method according to claim 13, further comprising:

in a continuous determination mode different from the diagnosis mode, continuously imaging sheets that have been subjected to a decoloring process by the heating portion;

counting a number of sheets that are sequentially imaged and have a readable image in the same location thereon after the decoloring process;

comparing the counted number to a preselected number; and determining whether or not the heating portion is defective if the counted number reaches the preselected number.

* * * * *